US005967234A

United States Patent [19]

Shaposhnikov et al.

[11] Patent Number: 5,967,234

[45] Date of Patent: Oct. 19, 1999

[54] METHOD OF AND DEVICE FOR PRODUCTION OF HYDROCARBONS

[75] Inventors: Vladimir M. Shaposhnikov; Leonid A. Kuslitskiy, both of Brooklyn; Semen Tseytlin, Middle Village; Leonid Listengarten, Brooklyn; Leonid Mendelevich, Brooklyn; August Kuslitsky, Brooklyn, all of N.Y.

[73] Assignee: Petroenergy LLC, New York, N.Y.

[21] Appl. No.: 09/071,994

[22] Filed: May 2, 1998

Related U.S. Application Data

[60] Provisional application No. 60/424,381, Aug. 13, 1997, and provisional application No. 60/434,155, Oct. 4, 1998.

[51] Int. Cl.[6] ..... E21B 34/06

[52] U.S. Cl. ..... 166/373; 166/53; 166/383; 166/386

[58] Field of Search ..... 166/370, 373, 166/53, 319, 383, 386

[56] References Cited

U.S. PATENT DOCUMENTS 4,921,048 5/1990 Crow et al. ..... 166/53 X 5,101,907 4/1992 Schultz et al. ..... 166/319 X 5,238,070 8/1993 Schultz et al. ..... 166/319 X

*Primary Examiner*—Roger Schoeppel

*Attorney, Agent, or Firm*—Ilya Zborovsky

[57] ABSTRACT

During a production of hydrocarbons a method and a device are used for producing a flow of hydrocarbon-containing formation fluid from a formation at a bottomhole of a well, automatically maintaining a pressure of the formation fluid at the bottomhole of the well at a level sufficient for maintaining an optimum flow of the formation fluid from the formation at the bottomhole of the well towards a wellhead by changing a parameter of a flow passage of an automatically maintaining unit arranged in the well in response to changes in properties of the formation and formation fluid, and performing the changing of the parameter of the flow passage of the automatic maintaining unit in response to a difference of a formation fluid flow parameter upstream and downstream of the automatic maintaining means.

8 Claims, 2 Drawing Sheets

METHOD OF AND DEVICE FOR PRODUCTION OF HYDROCARBONS

The priority benefit of Provisional Applications No. 424,391 filed Aug. 13, 1997 and No. 434,155 filed Apr. 10, 1998 is herewith claimed.

BACKGROUND OF THE INVENTION

The present invention relates to a method of and a device for production of hydrocarbons, in particular oil from wells.

Methods and devices of the above mentioned general type are known in the art. One of such methods is disclosed for example in U.S. Pat. No. 5,105,889. The device disclosed in this reference includes a set of axially vertically aligned pipes of different diameters and length, representing a multiparameteric hydrodynamic system which establishes a certain precalculated bottomhole pressure below the device, in order to decrease gas blockage of the near bottomhole zone of the formation and to provide a stable fluid flow to the surface. A forced fluid degassing takes place the device, creating a two-phase gas-liquid emulsion in order to provide a sufficient fluid lift within the well. The device disclosed in this patent has however certain limitations. A pressure differential depends on the calculated diametrical parameters of the pipes, which correspond to current values of parameters of the flow and the formation. Such stringent dependency restricts the adaptability of the device to changing reservoir and well conditions. Geometrical sizes of the pipes on which the efficiency of the device depends are based on such data as reservoir and bottomhole pressure, reservoir collecting properties, physical oil and gas characteristics, etc. The data may not accurately correspond to the actual current conditions resulting in an impaired efficiency of the bottomhole device. In the calculations some operational procedures can not be taken into consideration such as completion and shut-in of an adjacent well, thus impairing well parameters and affecting performance of the well with the bottomhole device. There is however a long period of time from the date when the well and the parameters are taken, than the sizing calculations of the device are performed, and the device is manufactured and installed in the well. During this time the parameters may change and the calculations will be inaccurate.

Another method and device is disclosed in U.S. Pat. No. 5,752,570. In accordance with this patent, bottomhole pressure is automatically maintained higher than a current saturation pressure of the formation fluid with gas in the near bottomhole zone of the formation, regardless of fluctuations of fluid pressure in the formation, in order to create fluid flow with minimum gas content. Once the bottomhole pressure decreases, the device automatically creates conditions for formation of a fluid flow into the device with an increased speed. Nearly monophase flow is transformed within the device into a finely dispersed gas-liquid flow, in order to provide its lift to the wellhead. The device disclosed in this reference automatically adjusts bottomhole pressure to a desired level, simultaneously providing a pressure drop, in order for the fluid to degass within the transforming area, according to the device inlet pressure at the bottomhole. However, in the process of oil field development, operational conditions change as well as the inflow performance curve corresponding to a current well operation, and the sensing element of the device disclosed in this reference will no longer maintain the same optimal well operation, since its calibration was based on the previous well information parameters. Also, in the device disclosed in this reference, the regulation is performed by means of changing an inlet diameter of the device, which is based on extremely little movement of its elements. Besides in case of unstable well operation, the regulating system may acquire automatic fluctuations. Calculations have proven that in some wells a space between the inner nozzle surface and the outer surface of the regulating cone of the device reduces approximately 0.01 inch. With such a small space even a trace of sand in the fluid can jam the regulating unit and stop the well. Since the pressure difference depending on the movement of the regulating cone has a non linear characteristic and is a function of fixed power of the diameter of the regulatable cross-section, it impedes precise regulations.

SUMMARY OF THE INVENTION

Accordingly, it is an object of the present invention to provide a method of and a device for production of hydrocarbons, which avoids the disadvantages of the prior art.

More particularly, it is an object of present invention to provide a method of and a device for production of hydrocarbons by means of automatic setting and maintaining a bottomhole pressure at an optimal level and fluid flow within a wide range of their parameters without the necessity of replacing the device.

It is also an object of present invention to provide a method of and a device for production of hydrocarbons which allow a self-regulating operation with regulation of a multi-phase flow under changing formation conditions and with varying fluid parameters.

It is also an object of present invention to provide a method of and device for production of hydrocarbons, which are characterized of smooth characteristics of regulation of hydraulic resistance to a fluid flow, capable of a smooth, flexible and precise regulation of the system well-formation with in a wide range of well flow rates.

Still another object of present invention is to avoid generation of sound speeds of the flow in the device within a calculated range of yields.

Accordingly, it is an object of present invention to provide a method of production of hydrocarbons comprising the steps of producing a flow of hydrocarbon-containing formation fluid from a formation at a bottomhole of a well, automatically maintaining a pressure of the optimum formation fluid at the bottomhole of the well at a level sufficient for maintaining the flow of the formation fluid from the formation at the bottomhole of the well towards a wellhead by changing a parameter of a flow passage of an automatically maintaining means arranged in the well; in response to changes in properties of the formation and formation fluid and performing the changing of the parameter of the flow passage of the automatic maintaining means in response to a difference of a formation fluid flow parameter upstream and downstream of said automatic maintaining means.

In accordance with another feature of the present invention, a device for production of hydrocarbons from a well having a bottomhole and a wellhead and communicating with a formation, the device has means for producing a flow of hydrocarbon-containing formation fluid from the formation at the bottomhole of the well; means for automatically maintaining a pressure of the formation fluid at the bottomhole of the well at a level sufficient for maintaining optimum the flow of the formation fluid from the formation at the bottomhole of the well to the wellhead by changing a parameter of flow passage of said automatic maintaining means arranged in the well in response to changes in properties of the formation and the formation fluid; and means for detecting a difference of a formation fluid flow parameter upstream and downstream of said automatic maintaining means, so that the parameter of the flow passage of said automatic maintaining means is changed in dependence on said differences of a formation fluid flow parameter upstream and downstream of said automatic maintaining means.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
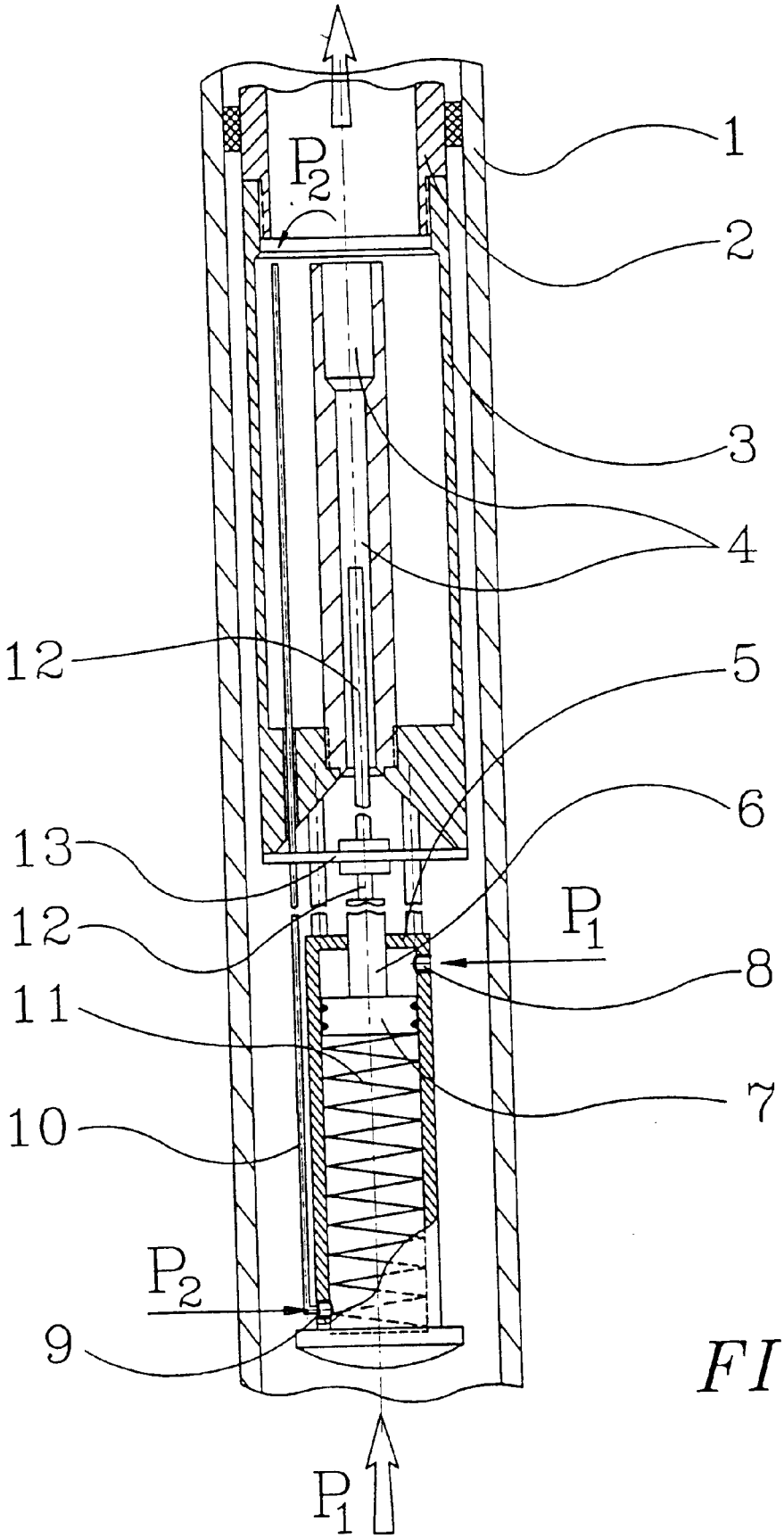
FIG. 1 is a view showing a method of and a device for production of hydrocarbons in accordance with the present invention.

A device in accordance with the present invention includes a known well tubing which is identified with reference numeral 1 and arranged a well. A flow of hydrocarbon-containing formation fluid flows through the well tubing 1 from a bottomhole near a formation to a wellhead.

A device for automatically maintaining a pressure of the formation fluid at the bottomhole of the well at a level sufficient for maintaining the optimum flow of the formation fluid from the formation at the bottomhole of the well to the wellhead in accordance with the present invention includes a set of interconnecting elements located in the well tubing 1. The device is fixed to the well tubing 1 by a locking element 2 which is installed hermetically in the well tubing at a certain depth. The device has a body which is identified with reference numeral 3 and attached to a bottom part of the locking element, for example by threaded connection. A plurality of pipes 4 are provided inside the body 3. The device further has a double-acting cylinder-piston unit including a cylinder 5 and a piston 7 with a piston rod 6 reciprocatingly movable in the cylinder 5. The cylinder 5 is connected to the lower part of the body 3.

The upper part of the cylinder above the piston 7 or downstream of the piston as considered in direction of flow of the formation fluid is provided with a port 8 through which the fluid from the bottomhole can flow into the interior of the cylinder 5 above the piston 7. The fluid flow entering the upper part of the cylinder 5 above the piston 7 has a pressure $P_1$ which is applied to the piston 7 from above. The lower part of the cylinder 5 has a port 9 located below the piston 7 or downstream of the piston 7 as considered in direction of flow of the formation fluid. The port 9 is connected by a connecting pipe 10 to a space above the device 4,5,6,7. The port 9 is filled with the formation fluid having a pressure $P_2$ which is applied to the lower surface of the piston 7 from below.

The device is further provided with a balancing spring 11 which can be located inside or outside of the cylinder 5, above or below it, in accordance with the well conditions. A cylinder needle 12 is attached to the piston rod 6 coaxially with the set of the pipes 4. During the reciprocating movement of the piston 7 in the cylinder 5, the needle 12 is displaced within a lower pipe of the multi-pipe set of the inventive device, along the axis of the device. During the displacement of the needle 12 within an inner opening of the lower pipe of the device, a length of an annular passage formed around the needle 12 changes.

Finally, a central support 13 operates as a bearing for a cantilever part of the needle and as an upper stop for the stroke of the piston rod 6.

The method in accordance with the present invention is performed and the device in accordance with the present invention operates in the following manner.

During the operation of a well, the formation parameters, such as formation pressure, gas, oil and water saturation, phase permeability as well as fluid parameters, such as water-oil and gas-oil ratio, viscosity, surface tension, etc. change. In the oil industry it was necessary to replace the equipment in the well with a new equipment having characteristics corresponding to the current formation and fluid parameters. With the method and device in accordance with the present invention no replacement of the equipment is needed. The device automatically maintains a pressure of the formation fluid at the bottomhole of the well at a level sufficient for maintaining the optimum flow of the formation fluid from the formation at the bottomhole of the well to the wellhead. The device in accordance with the present invention provides automatic adjustment of its parameters in response to the changing formation parameters and fluid properties.

An increased differential pressure between the formation and the bottomhole pressure usually results in increased oil flow rates. However, in formations with high gas-oil ratio, a decrease in bottomhole pressure causes formation oil degassing in the near bottomhole zone of the formation, increase in oil viscosity, reduction of the formation oil permeability and as a result, reduction of the formation productivity. Further reduction of bottomhole pressure may result in a decrease of oil flow rate rather than an increase. The valve pressure is optimal when its subsequent decrease leads not to an increase of the yield but instead to a decrease of the yield. The optimum pressure will change in time according to change of parameters of fluid and formation. Maintenance of an optimum bottomhole pressure by means of the inventive device in the formations with gas and water coning provides for the maximum oil flow rates with minimum gas and water flow rates.

In the beginning of the operation of the inventive device, the needle 12 is completely introduced into the lower pipe 4 of the pipe set. In some cases it can be not completely introduced, and in other cases it can be completely withdrawn from the lower pipe, depending on the well and formation conditions. After installation of the device and starting of the well, the phase oil permeability, in the near bottomhole zone of the reservoir increases and as a result the oil flow rates also increase. In response, the pressure differential within the device grows. The piston 7 is displaced in the cylinder 5, and in turn it displaces the needle 12. The piston 7 is under a pressure differential $P_1-P_2$. The piston 7 is balanced by the spring 11 such that the initial movement of the piston connected with the needle 12 starts when a force generated by the pressure differential exceeds a force of the pre-compressed spring:

$\Delta PS=(P1-P2)S>F_{spr}$, wherein S is a cross-sectional area of the piston.

Before any movement of the piston, the pressure differential within the device corresponds to the initial hydraulic resistance, with the cylinder needle pushed into the lower pipe. After the increase of the flow rate to a certain level when its further growth may cause extremely rapid increase of pressure differential within the device, the needle 12 starts to pull down from the lower pipe 4. When $\Delta PS<F_{spr}$, wherein $F_{spr}$ is the force of the spring, the hydraulic resistance of the device reduces, maintaining bottomhole pressure at an optimum level. Such dependence of the bottomhole pressure and the movement distance is based on certain computer simulators which calculate a pressure distribution in the reservoir, well and in the device. Operational characteristic of the spring is calculated in accordance with the above mentioned considerations.

When the cylinder needle 12 is completely pulled out of the lower pipe, the hydraulic resistance of the device is minimal. Such resistance corresponds to a resistance of the whole system of the pipes having a round cross-section. The pressure differential within the device in response to a further increase of flow rates will be based on a constant (minimal) hydraulic resistance of the lower pipe, as well as another pipe, and further pipes of the multi-pipe system. It is important that after the needle 12 starts to pull down from the lower pipe, the lower pipe becomes a system of two pipes, including a round pipe and a coaxial pipe. If the flow rates decrease due to some changes in the reservoir and fluid parameters and reduction of the reservoir pressure, the needle 12 will start moving back into the lower pipe so as to adjust the hydraulic resistance of the device to an optimum level in order to maintain optimum bottomhole pressure and maximum oil flow rates according to the current conditions of the reservoir, reservoir pressure, and fluid parameters.

Due to the above described self-regulation the inventive device can operative efficiently in a wider range of reservoir and fluid parameters varying with time without the necessity to remove the device from the well.

When the method is performed and the device in accordance with present invention, they provide an increase in oil well production and recovering index by maintaining stable fluid flow rates at an optimum (maximum) level according to current reservoir condition, fluid parameters and recovery method. A considerably prolonged duration of the well life operating due to the inventive device is provided without the necessity to replace the device. An improved regulation of parameters of the system reservoir-well due to the flexible, smooth and precise device operation is achieved within a wide range of pressure levels, fluid flow compositions and flow rates. Numerous wireline operations on the device installation/removal in order to replace pipe system due to the change of reservoir and fluid parameters and lift conditions are dispensed with. The geometrical parameters of the device automatically adjust in response to changing formation and fluid parameters. There is no fluid flow rate limitation when the fluid speed within the device reaches a sound velocity. Also, the regulation is performed as a two stage regulation when necessary, in particular a rigid regulation in the beginning uninterruptedly transforming into a smooth and flexible regulation of fluid flow hydraulic resistance at the end.

An example for designing the device in accordance with the present invention with a movable needle is presented hereinbelow.

Figure 2:
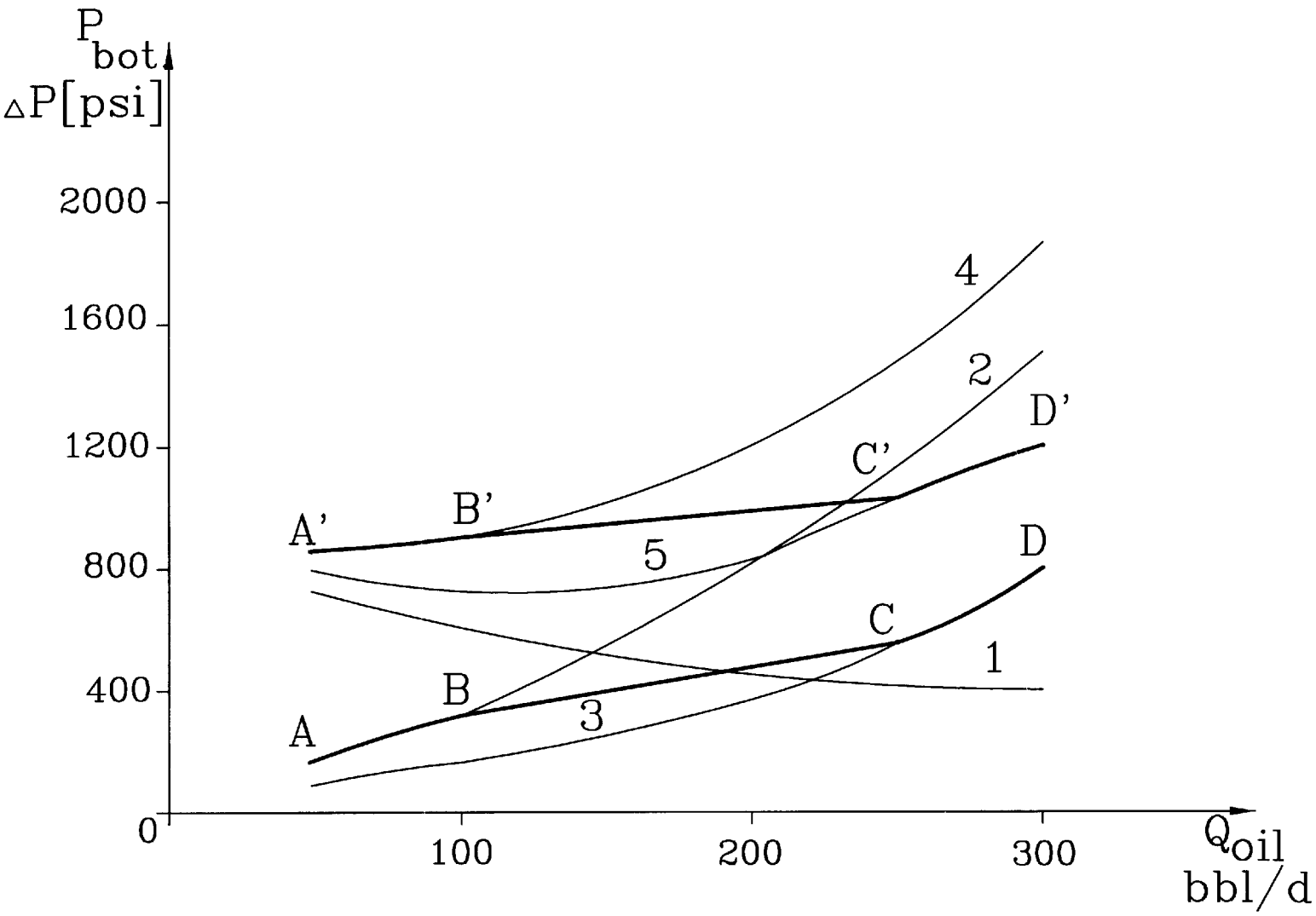
FIG. 2 is a view showing illustrating characteristic curves for regulation of production of hydrocarbons by the method and the device in accordance with the present invention.

The example is ratio WOR=0.3, with formation pressure $P_f$=2000 PSl and bubble point pressure bubble $P_{bp}$=2100 PSl. A lift curve which reflects the dependency of change of the bottomhole pressure from the yield of oil with a diameter tubing $D_t$=0.203 ft and a wellhead pressure $P_{WH}$=120 PSl is represented by the curve 1 in FIG. 2.

In order to maintain an optimum mode of operation of the system well-formation, as was shown by a computer simulation phase filtration in the formation, it is necessary to maintain the bottomhole pressure within the range of 850–1200 PSI with expected change of oil yield from 50 to 300 $^{BBL}/_{D}$, and GOR correspondingly from 3000 to 350 $^{SCT}/_{BBL}$.

For this example, a device which maintains the required mode is a two-pipe device which is disclosed hereinabove, with a diameter of the lower pipe D1=0.014 ft (4.3 mm) and length L=0.3 D, a diameter of the upper pipe D2=0.03 ft and $L_2$=0.6 f. The cylindrical needle with a diameter Di=0.0075 ft and L1=0.3 ft moves inside the lower pipe. The calculated value of the pressure difference at device in the event when the needle is completely introduced is represented by a curve 2 in FIG. 2. The case which corresponds to the completely introduced needle is represented by the curve 3 in FIG. 2. If the needle were introduced and immovable, then the bottomhole pressure will change in accordance with the low represented by the curve 4, even with the yields $Q_{oil} \leqq 200$ $^{BBL}/_{D}$. The value of the bottomhole pressure will be $P_{bot} \leqq 1200$ PSl, or in other words beyond the range of the adjustment.

However, the spring which is preliminarily compressed is adjusted so that the movement of the needle starts from the bottomhole pressure 900 PSl. With this situation, the value of the pressure difference at the device ΔP when the needle moves follows the characteristic of change represented by the curve BC. In other words, with the change of the yield from 100 to 250 $^{BBL/}_{D}$, the bottomhole pressure changes from 900 to 1050 PSl (portion B', C'). The points C and C' corresponds to the incompletely extracted needle, and then the pressure difference at the device will be determined by the portion CD of the curve 3. Therefore, in the whole range of regulation when the well yield changes from 50 to 300 $^{BBL}/_{D}$, the pressure difference at the device changes 120 to 800 PSl (in accordance with the curved A, B, C, D, and the bottomhole pressure changes from 850 to 1200 PSl (curve A', B', C', D').

Therefore smooth regulation of the bottomhole pressure within the whole range of yield changes is performed without the replacement of the device.

It will be understood that each of the elements described above, or two or more together, may also find a useful application in other types of methods and constructions differing from the types described above.

While the invention has been illustrated and described as embodied in method of and device for production of hydrocarbons, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of production of hydrocarbons comprising the steps of producing a flow of hydrocarbon-containing formation fluid from a formation at a bottomhole of a well, automatically maintaining a pressure of the formation fluid at the bottomhole of the well at a level sufficient for maintaining an optimum flow of the formation fluid from the formation at the bottomhole of the well towards a wellhead by changing a parameter of a flow passage of an automatically maintaining means arranged in the well in response to changes in properties of the formation and formation fluid and performing the changing of the parameter of the flow passage of the automatic maintaining means in response to a difference of a formation fluid flow parameter upstream and downstream of the automatic maintaining means.

2. A method as defined in claim 1, wherein said maintaining step includes first reacting of the automatic maintaining means to changes in properties of the formation and the formation fluid such that no parameter of the flow passage of the automatic maintaining means changes, and only thereafter the parameter of the flow passage of the automatic maintaining means changes.

3. A method as defined in claim 1, wherein said changing the parameter of the flow passage of the automatic maintaining means includes changing a length of an annular portion of the flow passage of the automatic maintaining means in response to changes in properties of the formation and formation fluid.

4. A method as defined in claim 1, wherein said performing includes changing the parameter of the flow passage of the automatic maintaining means in response to a difference of a formation fluid pressure upstream and downstream of the automatic maintaining means.

5. A device for production of hydrocarbons from a well having a bottomhole and a wellhead and communicating with a formation, the device comprising means for producing a flow of hydrocarbon-containing formation fluid from the formation at the bottomhole of the well; means for automatically maintaining a pressure of the formation fluid at the bottomhole of the well at a level sufficient for maintaining an optimum flow of the formation fluid from the formation at the bottomhole of the well to a wellhead by changing a parameter of a flow passage of said automatic maintaining means arranged in the well in response to changes in properties of the formation and the formation fluid; and means for detecting a difference of a formation fluid flow parameter upstream and downstream of said automatic maintaining means, so that the parameter of the flow passage of said automatic maintaining means changes in dependence on said differences of a formation fluid flow parameter upstream and downstream of said automatic maintaining means.

6. A device as defined in claim 5, wherein said automatic maintaining means is formed so that in response to changes in properties of the formation and the formation fluid the parameter of the flow passage of an automatic maintaining means is first not changed, and only thereafter the parameter of the flow passage of the automatic maintaining means is changed.

7. A device as defined in claim 5, wherein said automatic maintaining means is formed so that a length of an annular portion of the flow passage of said automatic maintaining means changes in response to changes in properties of the formation and formation fluid.

8. A device as defined in claim 5, wherein said automatic maintaining means is formed so that the changing of the parameter of the fluid passage of the automatic maintaining means is performed in response to a difference of a formation fluid pressure upstream and downstream of said automatic maintaining means.

* * * * *